United States Patent [19]

Kuwahara

[11] Patent Number: 5,046,323

[45] Date of Patent: Sep. 10, 1991

[54] MULTI-SYSTEM AIR CONDITIONER

[75] Inventor: Eiji Kuwahara, Fuji, Japan

[73] Assignee: Kabushiki Kaisha Toshiba, Kawasaki, Japan

[21] Appl. No.: 546,885

[22] Filed: Jul. 2, 1990

[30] Foreign Application Priority Data

Jul. 3, 1989 [JP] Japan ..... 1-171405

[51] Int. Cl.[5] ..... F25D 21/02; F25D 21/06

[52] U.S. Cl. ..... 62/140; 62/156; 62/160

[58] Field of Search ..... 62/160, 324.1, 324.6, 62/81, 278, DIG. 17, 140, 156; 237/2.8

[56] References Cited

U.S. PATENT DOCUMENTS

| | | | |
|---|---|---|---|
| 2,761,287 | 9/1956 | Malkoff et al. | 62/DIG. 17 X |
| 3,170,305 | 2/1965 | Dibble et al. | 62/155 |
| 4,338,791 | 7/1982 | Stamp, Jr. et al. . | |
| 4,878,357 | 11/1989 | Sekigami et al. | 62/324.6 |

FOREIGN PATENT DOCUMENTS

| | | |
|---|---|---|
| 0299361 | 1/1988 | European Pat. Off. . |
| 2561363 | 9/1985 | France . |
| 61-45145 | 10/1986 | Japan . |
| 2229551 | 9/1990 | United Kingdom . |
| 2230873 | 10/1990 | United Kingdom . |

*Primary Examiner*—William E. Wayner

*Attorney, Agent, or Firm*—Cushman, Darby & Cushman

[57] ABSTRACT

An air conditioner is disclosed which includes a unit for setting a defrost mode, as required, when the heating operation mode is determined, a unit for enabling the refrigerant which is delivered from the compressor to flow through one or more indoor units calling for the heating operation mode, when the defrost mode is set, and to be returned back to the compressor through one or more indoor units calling for the cooling operation mode, and a unit for enabling a stream of the refrigerant which is delivered from the compressor to pass through the outdoor heat exchanger, when the defrost mode is set, and to enter the stream of the refrigerant flowing into one or more indoor units calling for the cooling operation mode.

9 Claims, 10 Drawing Sheets

MULTI-SYSTEM AIR CONDITIONER

BACKGROUND OF THE INVENTION

1. Field of the Invention

The present invention relates to a multi-system air conditioner including a plurality of indoor units.

2. Description of the Related Art

Known in the art is a multi-system air conditioner which includes one outdoor unit and a plurality of indoor units and provides a heat pump type refrigerating apparatus among the units.

The multi-system air conditioner of this type can heat or cool a plurality of rooms in a house or a building at a time and is convenient in this sense.

In those buildings, however, some having a computer room, some having a perimeter zone and some having an interior zone, a cooling request comes from a given location or locations and, at the same time, a heating request comes from other locations.

In this case, it is not possible to operate the air-conditioner such that one of the heating and cooling requests is given a priority over the other.

There is a possibility that a better environment will be created at some location but that the workers in other locations will feel uncomfortable or apparatuses, such as computers, in still other locations will sometimes fail.

Such an unfavorable condition or conditions are liable to occur in the buildings or the common houses having a plurality of rooms, often in the intervening season between the spring and the autumn.

A new air-conditioner emerges as in Published Examined Japanese Patent Application 61-45145, which discloses the concept of operating at least one of several indoor units in a cooling operation mode and one or more remaining indoor units in a heating operation mode. Such a type of air conditioner can eliminate the aforementioned drawbacks.

In the aforementioned air-conditioner, an outdoor heat exchanger acts as an evaporator and the heat of absorption of the outdoor heat exchanger and that of the cooling operation-side indoor unit are utilized as the liberation of heat of the heating operation-side indoor unit or units.

During the operation of the air-conditioner, a decline in the outer air causes frost to gradually occur on the surface of the outdoor heat exchanger, thus lowering the heating power level upon the continuance of that condition.

The conventional way of solving the aforementioned problem is by reversing the direction in which a refrigerant of a cooling operation cycle is flowed, as required, and thawing the frost on the outdoor heat exchanger by a hot version of a refrigerant which has been delivered from the compressor.

Since, in this case, the flow of the refrigerant is reversed in its direction; the liberation of heat on the heating operation-side indoor unit is interrupted, failing to create a comfortable atmosphere around the workers or occupants in the room.

SUMMARY OF THE INVENTION

It is accordingly the object of the present invention to provide a multi-system air conditioner which can perform a cooling and a heating mode of operation simultaneously at a plurality of indoor units and can remove frost on an outdoor heat exchanger without interrupting the liberation of heat on the heating operation-side indoor unit.

According to the present invention, there is provided a multi-system air conditioner, comprising:

an outdoor unit including a compressor for sucking a refrigerant, compressing it and delivering it and an outdoor heat exchanger for allowing an exchange of a heat of an incoming refrigerant and a heat of outdoor air;

a plurality of indoor units each including an indoor heat exchanger for allowing an exchange of a heat of an incoming refrigerant and a heat of indoor air and requesting at least one of a cooling operation mode and cooling power level and a heating operation mode and heating power level;

means for determining the cooling operation mode when a total of a cooling power level or levels requested from one or more indoor units is greater than a total of a heating power level or levels requested from one or more remaining indoor units;

means for enabling the refrigerant which is delivered from the compressor to flow through the outdoor heat exchanger, when the cooling operation mode is determined, and to be returned back to the compressor through one or more indoor units calling for the cooling operation mode;

means for enabling one stream of the refrigerant which is delivered from the compressor to flow through one or more indoor units calling for the heating operation mode, when the cooling operation mode is determined, and to enter the refrigerant of one or more indoor units calling for the cooling operation mode;

means for determining the heating operation mode when a total of a heating power level or levels requested from one or more indoor units is greater than a total of a cooling power level or levels requested from one or more remaining units;

means for enabling the refrigerant which is delivered from the compressor to flow through one or more indoor units calling for the heating operation mode, when the heating operation mode is determined, and to be returned back to the compressor via the outdoor heat exchanger;

means for enabling one stream of the refrigerant which passes through one or more indoor units calling for the heating operation mode to flow through one or more indoor units calling for a cooling operation mode, when the heating operation mode is determined, and to be returned back to the compressor;

means for setting a defrost mode, as required, when the heating operation mode is determined;

means for enabling the refrigerant which is delivered from the compressor to flow through one or more indoor units calling for the heating operation mode, when the defrost mode is set, and to be returned back to the compressor through one or more indoor units calling for the cooling operation mode; and means for enabling a stream of the refrigerant which is delivered from the compressor to pass through the outdoor heat exchanger, when the defrost mode is set, and to enter the stream of the refrigerant flowing into one or more indoor units calling for the cooling operation mode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An air conditioner according to a first embodiment of the present invention will be explained below with reference to the accompanying drawings.

Figure 1:
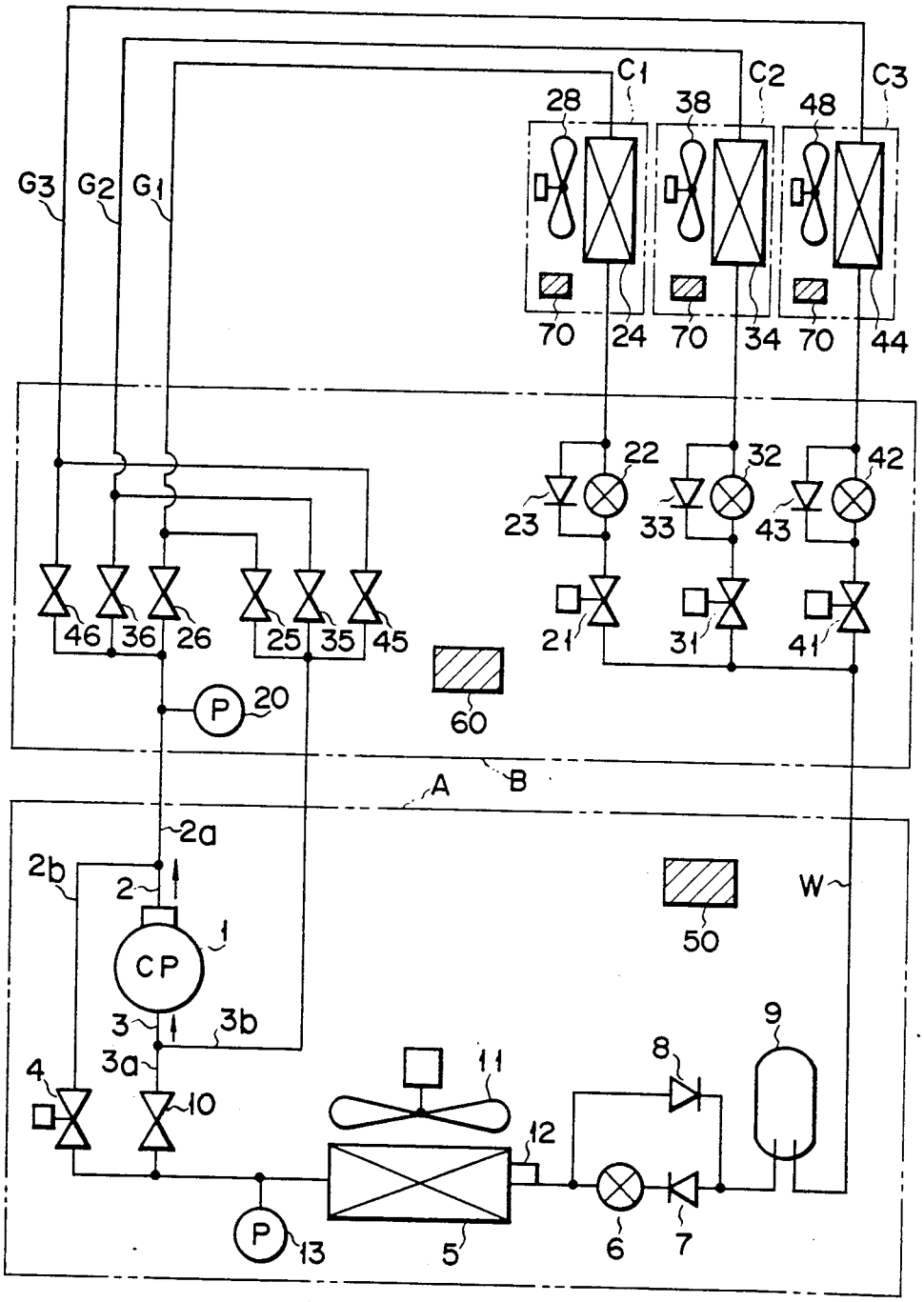
FIG. 1 is a view showing an arrangement of a refrigerating apparatus according to a first embodiment of the present invention.

In FIG. 1, the character "A" represents an outdoor unit which is connected by a branch unit B to a plurality of indoor units C1, C2 and C3.

The outdoor unit A, branch unit B and indoor units C1, C2 and C3 provide a refrigerating apparatus as will be set out below.

The outdoor unit A includes a capacity-variable compressor 1 adapted to compress a refrigerant sucked from a suction inlet and deliver it from a delivery outlet.

. A delivery tube 2 is connected to the delivery outlet of the compressor 1.

A suction tube 3 is connected to the suction inlet of the compressor 1.

The delivery tube 2 is branched into two delivery tubes 2*a*, 2*b*.

The suction tube 3 is branched into two suction tubes 3*a*, 3*b*.

An outdoor heat exchanger 5 is connected via a pulse motor valve (hereinafter referred to as a PMV) 4 to the delivery tube 2*b* and adapted to make an exchange between a heat of an incoming refrigerant and a heat of outdoor air.

A liquid tank 9 is connected to the outdoor heat exchanger 5 via a check valve 8 in one route and via a series circuit of an expansion valve 6 and check valve 7 in another route. A liquid side tube W is connected to the liquid tank 9.

The suction tube 3*a* of the compressor 1 is connected to a tube between the PMV 4 and the outdoor heat exchanger 5 via an electromagnetic type two-way valve 10.

Expansion valves 22, 32 and 42 in the branch unit B are connected to the liquid-side tube W, respectively, through PMV's 21, 31 and 41 in the branch unit B. In the branch unit B, check valves 23, 33 and 43 are connected to the expansion values 22, 32 and 42 in a parallel array.

Indoor heat exchangers 24, 34 and 44 in the indoor units C1, C2 and C3, respectively, are connected to the corresponding expansion valves 22, 32 and 42. The indoor heat exchangers 24, 34 and 44 are adapted to make an exchange between a heat of an incoming refrigerant and a heat of indoor air.

Gas-side tubes G1, G2 and G3 are connected to the indoor heat exchangers 24, 34 and 44, respectively.

The gas-side tubes G1, G2 and G3 are each branched into two tubes.

One route of each of the gas-side tubes G1, G2 and G3 is connected to the suction tube 3*b* of the compressor 1 via a corresponding one of electromagnetic two-way valves 25, 35 and 45 in the branch unit B.

The other route of each of the gas-side tubes G1, G2 and G3 is connected to the delivery tube 2*a* of the compressor 1 via a corresponding one of electromagnetic type two-way valves 26, 36 and 46 in the branch unit B.

An outdoor fan 11 is provided in the outdoor unit A to allow outdoor air to circulate through the outdoor heat exchanger 5.

A temperature sensor 12 is mounted on the outdoor heat exchanger 5 to detect temperature prevalent in the outdoor heat exchanger 5.

A pressure sensor 13 is located at a tube extending from the PMV 4 and the two-way valve 10 to the outdoor heat exchanger 5. The pressure sensor 13 detects the pressure prevalent in the refrigerant flowing through the associated tube.

A pressure sensor 20 is provided at a tube extending to the delivery tube 2*a* of the compressor 1 from the two-way valves 26, 36 and 46 in the branch unit B.

Indoor fans 28, 38 and 48 are provided in the indoor heat exchangers 24, 34, 44 of the indoor units C1, C2 and C3, respectively, to allow outer air to circulate through the exchangers.

The outdoor unit A includes an outdoor control section 50.

The outdoor control section 50 controls an inverter circuit for compressor drive, PMV 4, two-way valve 10 and outdoor fan 11.

The branch unit B includes a multi-control section 60.

The multi-control section 60 controls the PMV's 21, 31 and 41, two-way valves 25, 35 and 45 and two-way valves 26, 36 and 46.

The indoor units C1, C2 and C3, each, include an indoor control section 70.

The respective indoor control section 70 supplies either one of a cooling operation mode/cooling power level request signal and heating operation mode/heating power level request signal to the multi-control section 60 and controls the corresponding one of the indoor fans 28, 38 and 48.

The following function means are provided by the outdoor control section 50, multi-control section 60, respective PMV's and respective two-way valves.

(1) A means is provided for determining a cooling operation mode when a total of a cooling power level or levels requested from one or more indoor units is greater than a total of a heating power level or levels requested from one or more remaining indoor units.

(2) A means is provided for allowing a refrigerant which is delivered from the compressor 1 to circulate through the outdoor heat exchanger 5 when a cooling operation mode is determined and for allowing it to be returned back to the compressor 1 through one or more indoor units by which a request or requests are made for the cooling operation mode.

(3) A means is provided for allowing one stream of a refrigerant which is delivered from the compressor 1 to circulate through one or more indoor units calling for the heating operation mode, when the cooling operation mode is determined, and for allowing it to enter a refrigerant stream flowing into one or more indoor units calling for the cooling operation mode.

(4) A means is provided for determining a heating operation mode when a total of a heating power level or levels requested from one or more indoor units is greater than a total of a cooling power level or levels requested from a remaining one or more indoor units.

(5) A means is provided for allowing a refrigerant which is delivered from the compressor 1 to circulate through one or more indoor units by which a request or requests are made for the heating operation mode and for allowing it to be returned back to the compressor 1 via the outdoor heat exchanger 5.

(6) A means is provided for allowing one stream of a refrigerant which passes through one or more indoor units calling for a heating operation mode to circulate through one or more indoor units calling for the cooling operation mode, when the heating operation mode is determined, and to be returned back to the compressor 1.

(7) A means is provided for setting a defrost mode, as required, when the heating operation is determined.

(8) A means is provided for allowing a refrigerant which is delivered from the compressor 1 to circulate through one or more indoor units calling for the heating operation mode, when a defrost mode is set, and for returning it back to the compressor 1 via one or more indoor units by which a request or requests are made for the cooling operation mode.

(9) A means is provided for allowing one stream of a refrigerant which is delivered from the compressor 1 to circulate through the outdoor heat exchanger 5, when the defrost mode is determined, and for allowing it to enter the refrigerant stream flowing into one or more indoor units calling for the cooling operation mode.

(10) A first pressure control means is provided which, when a defrost mode is set, allows a pressure which is detected by the pressure sensor 20 against a refrigerant stream flowing into one or more indoor units calling for the heating operation mode to be maintained at the set level.

(11) A second pressure control means is provided which, when a defrost mode is set, allows a pressure which is detected by the pressure sensor 13 against a refrigerant stream flowing into the outdoor heat exchanger 5 to be maintained at the set level.

Figure 2:
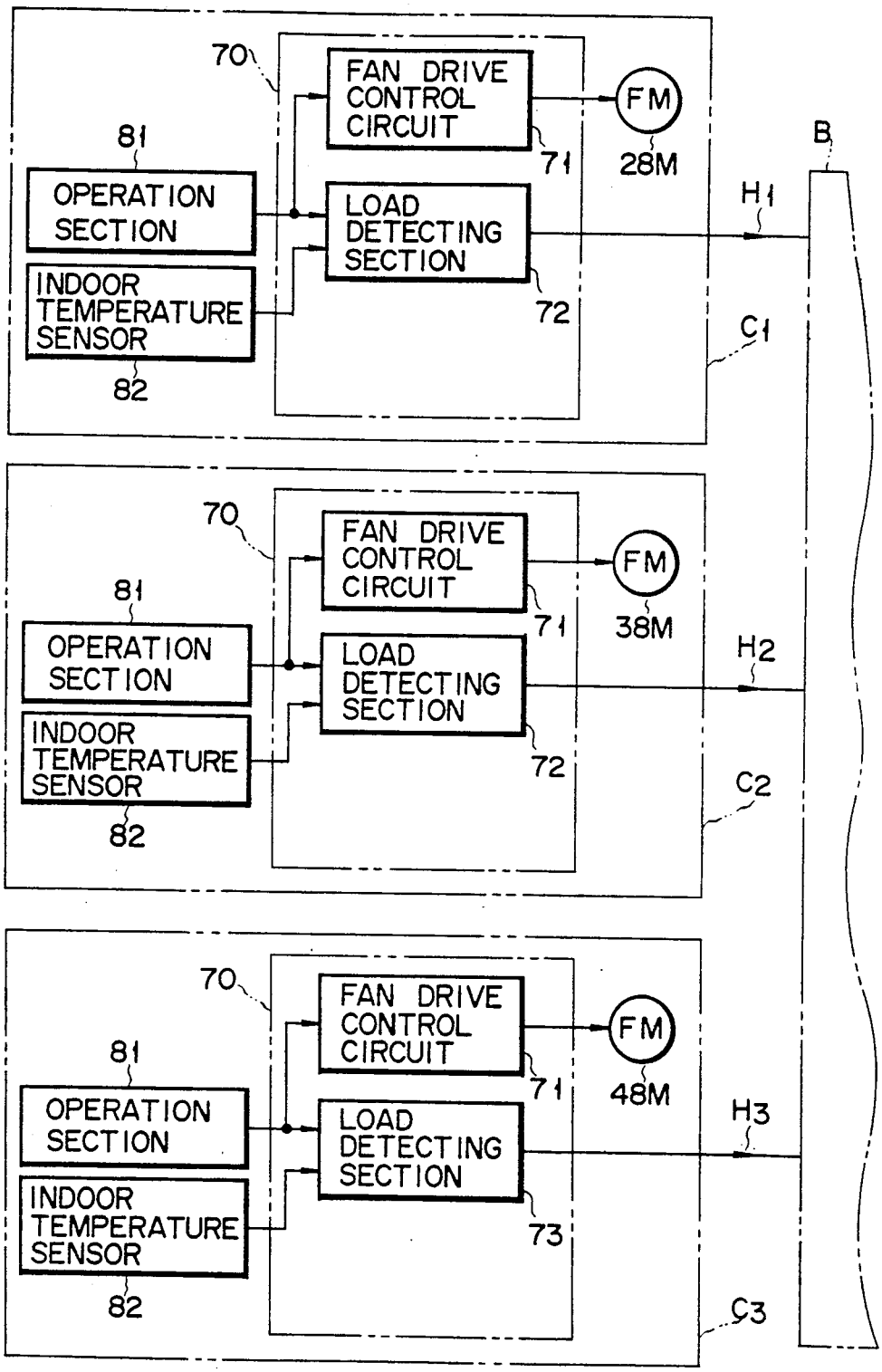
FIG. 2 is a block diagram showing an indoor control section of the aforementioned embodiment and its associated circuits.

The respective indoor control sections 70 and their associated practical arrangements are shown in FIG. 2.

The respective indoor control system 70 are each comprised of a fan drive control circuit 71 and a load detecting section 72.

Upon the operation of an operation section 81, the fan drive control circuit 71 in the indoor unit C1 controls a motor 28M for the indoor fan 28.

Upon the operation of an operation section 81, the fan drive control circuit 71 in the indoor unit C2 controls a motor 38M for the indoor fan 38.

Upon the operation of an operation section 81, the fan drive control circuit 71 in the indoor unit C3 controls a motor 48M for the indoor fan 48.

The load detecting section 72 in the indoor unit C1 has the following functions.

(1) A request made by the operation section 81 for a given operation mode is sent as a corresponding signal H1 to the multi-control section 60.

(2) A difference between an indoor temperature set by the operation section 81 and the detection temperature of the indoor temperature sensor 82, is detected as a load.

(3) A request for a cooling power level or a heating power level corresponding to the detected load is sent as a corresponding signal to the multi-control section 60.

The load detecting section 72 in the indoor unit C2 has various functions as will be set out below.

(1) A request made by the operation section 81 for a given operation mode is delivered as a corresponding signal H2 to the multi-control section 60.

(2) A difference between an indoor temperature set by the operation section 81 and the detection temperature of the indoor temperature sensor 82, is detected as a load.

(3) A request for a cooling power level or a heating power level corresponding to the detected load is sent as a corresponding signal H2 to the multi-control section 60.

The load detecting section 72 in the indoor unit C3 has various functions as will be set out below.

(1) A request made by the operation section 81 for a given operation mode is delivered as a corresponding signal H3 to the multi-control section 60.

(2) A difference between an indoor temperature set by the operation section 81 and the detection temperature of the indoor temperature sensor 82, is detected as a load.

(3) A request for a cooling power level or a heating power level corresponding to the detected load is sent as a corresponding signal H3 to the multi-control section 60.

Figure 3:
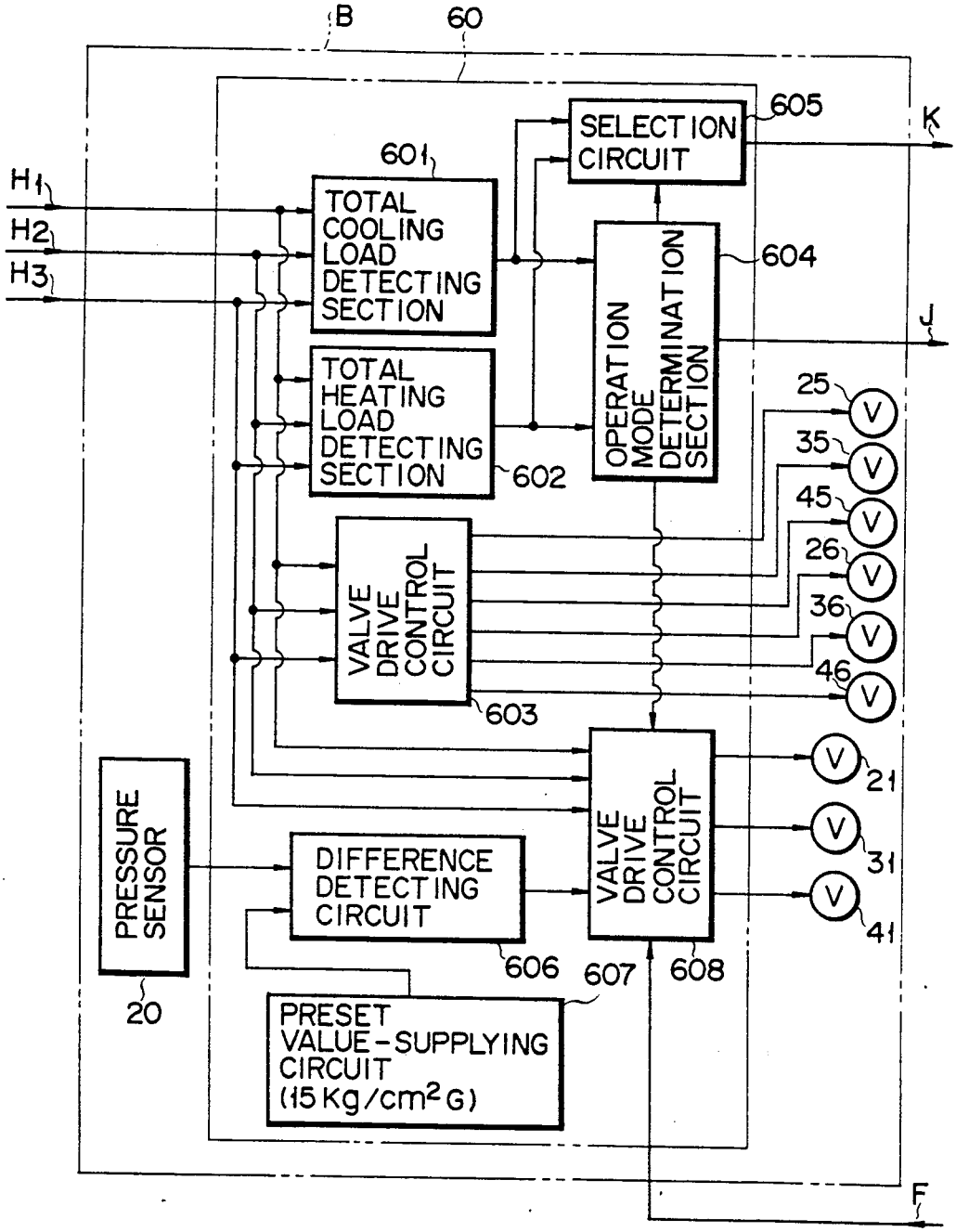
FIG. 3 is a block diagram showing a multi-system control section of the aforementioned embodiment and its associated circuits.

The multi-control section 60 and its associated arrangement are shown in FIG. 3.

The multi-control section 60 comprises a total cooling load detecting section 601, total heating load detecting section 602, valve drive control circuit 603, operation mode determination section 604, selection circuit 605, difference detecting circuit 606, preset valve circuit 607 and valve drive control circuit 608.

The total cooling load detecting section 601 has the following functions.

(1) The cooling power levels requested are determined from the aforementioned signals H1, H2 and H3 supplied from the respective indoor control sections 70.

(2) The total of the cooling power levels thus determined is detected.

The total heating load detecting section 602 performs the following functions.

(1) The heating power levels requested are determined from the signals H1, H2 and H3 of the respective indoor control section 70.

(2) The total of the heating power levels thus determined is detected.

The valve drive control circuit 603 has the following functions.

(1) A cooling operation mode or heating operation mode requested is determined from the signals H1, H2 and H3 of the respective indoor control section 70.

(2) The opening and closing of the two-way valves 25, 35 and 45 and 26, 36 and 46 are controlled in accordance with a result of determination. If, for example, the cooling operation mode is requested by the signal H1, the two-way valves 25 and 26 are opened and closed, respectively. If, on the other hand, the heating operation mode is requested by the signal H1, the two-way valves 25 and 26 are closed and opened, respectively.

The operation mode determination section 60 has the following functions.

(1) A cooling operation mode is determined when a total of the cooling power levels detected at the total cooling load detecting section 601 is greater than a total of heating power levels detected at the total heating load detecting section 602.

(2) A heating operation mode is determined when the total of the heating power levels detected at the total heating load detecting section 602 is greater than the total of the cooling power levels detected at the total cooling load detecting section 601.

(3) The result of determination is sent as a signal J to the outdoor control section 50.

The selection circuit 605 has the following functions.

(1) When the cooling operation mode is determined at the operation mode determination section 604, the total of the cooling power levels detected at the total cooling load detecting section 601 is sent as a signal K to the outdoor control section 50.

(2) When the heating operation mode is determined at the operation mode determination section 604, the total of the heating power levels detected at the total heating load detecting section 602 is sent as a signal K to the outdoor control section 50.

The difference detecting circuit 606 detects a difference between the detection pressure of the pressure sensor 20 and a preset value 15 kg/cm$^2$G of the preset value circuit 607.

The valve drive control circuit 608 controls PMV's 21, 31 and 41 and performs the following functions.

That is, the valve drive control circuit 608 performs the following functions when the operation mode determination section 604 determines a cooling operation mode.

(1) The cooling and heating operation modes requested are determined from signals H1, H2 and H3 of the respective indoor control section 70.

(2) When a cooling operation mode is requested by a signal H1, the extent of opening of the PWV 21 corresponding to the indoor unit C1 is controlled in accordance with a cooling power level requested by the signal H1. When a cooling operation mode is requested by a signal H2, the extent of opening of the PMV 31 corresponding to the indoor unit C2 is controlled in accordance with a cooling power level requested by the signal H2. When a cooling operation mode is requested by a signal H3, the extent of opening of the PMV 41 corresponding to the indoor unit C3 is controlled in accordance with a cooling power level requested by the signal H3.

(3) When a heating operation mode is requested by a signal H1, the extent of opening of the PWV 21 corresponding to the indoor unit C1 is controlled in accordance with a heating power level requested by the signal H1. When a heating operation mode is requested by a signal H2, the extent of opening of the PMV 31 corresponding to the indoor unit C2 is controlled in accordance with a heating level requested by the signal H2. When a heating operation mode is requested by a signal H3, the extent of opening of the PMV 41 corresponding to the indoor unit C3 is controlled in accordance with a heating power level requested by the signal H3.

The valve drive control circuit 60 performs the following operations when the operation mode determination section 604 determines a heating operation mode.

(4) The cooling and heating operation modes requested are determined from signals H1, H2 and H3 of the respective indoor control sections 70.

(5) When a heating operation mode is requested by a signal H1, the degree of opening of the PWV 21 is controlled in accordance with a heating power level requested by the signal H1. When a heating operation mode is requested by a signal H2, the extent of opening of the PWV 31 is controlled in accordance with a heating power level requested by the signal H2. When a heating operation mode is requested by a signal H3, the extent of opening of the PMV 41 is controlled in accordance with a heating power level requested by the signal H3.

(6) When a cooling operation mode is requested by a signal H1, the extent of opening of the PWV 21 corresponding to the indoor unit C1 is controlled in accordance with a cooling power level requested by the signal H1. When a cooling operation mode is requested by a signal H2, the extent of opening of the PMV 31 corresponding to the indoor unit C2 is controlled in accordance with a cooling power level requested by the signal H2. When a cooling operation mode is requested by a signal H3, the extent of opening of the PMV 41 corresponding to the indoor unit C3 is controlled in accordance with a cooling power level requested by the signal H3.

(7) When a defrost mode signal F is received from the outdoor control unit 50, the aforementioned control as set out in connection with this paragraph (5) above is stopped and the extent of opening of the PWV or PWV's corresponding to one or more indoor units calling for a heating operation mode, that is, an amount of refrigerant flowing into one or more indoor units calling for the heating operation mode, is so controlled that a result of detection by the difference detecting circuit 606 becomes zero.

A pressure sensor 20, difference detecting circuit 606, valve drive control circuit 608 and PMV's 21, 31 and 41 constitute a first pressure control means.

Figure 4:
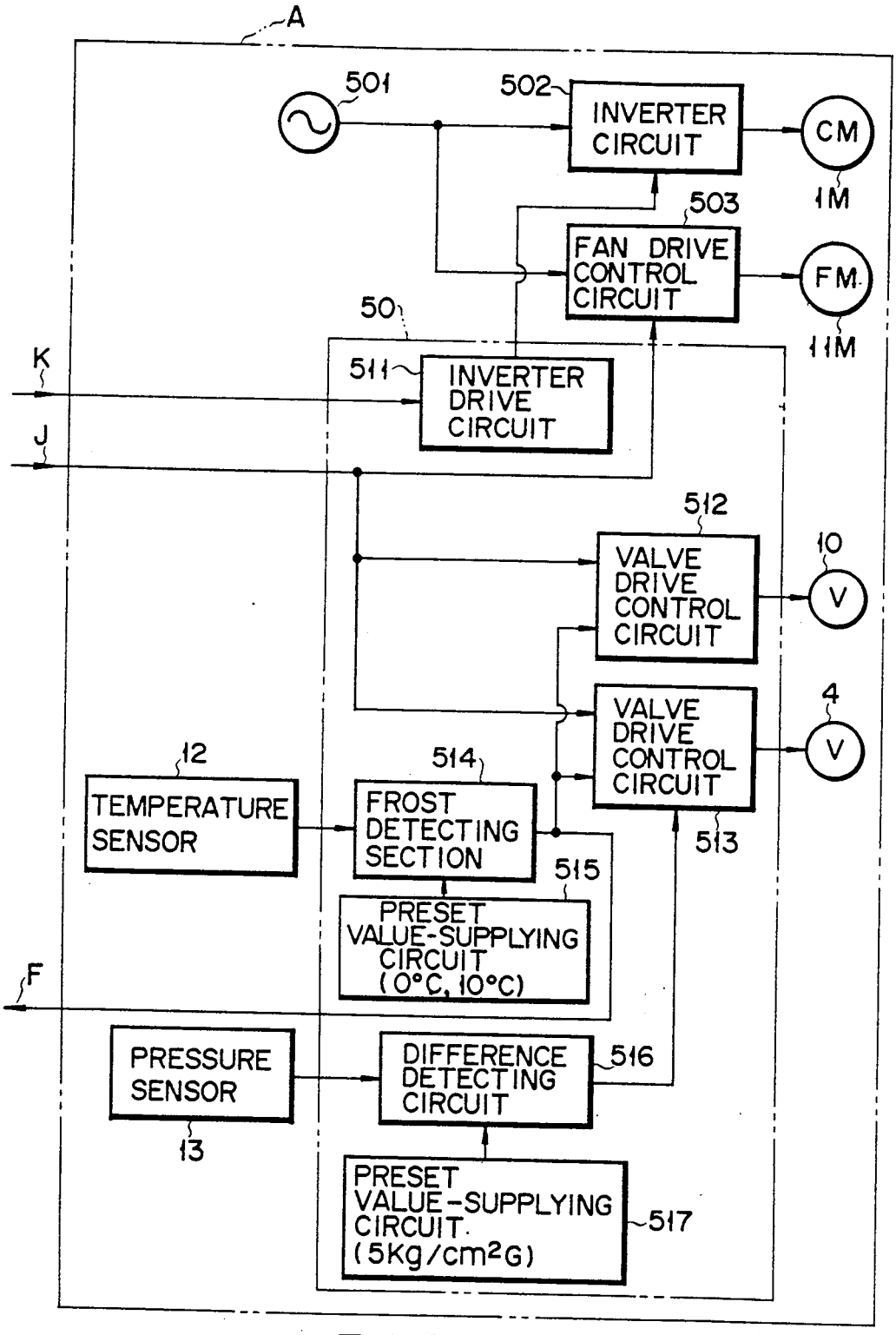
FIG. 4 is a block diagram showing an outdoor control section of the aforementioned embodiment.

FIG. 4 shows the outdoor control section 50 and its associated practical arrangement.

In FIG. 4, reference numeral 501 shows a commercial AC power supply to which are connected an inverter circuit 502 and fan drive control circuit 503.

The inverter circuit 502 rectifies a voltage waveform of the AC power supply 501, converts the rectified voltage waveform to an alternate voltage of a predetermined frequency and delivers it as such. The output voltage of the inverter circuit 502 is supplied as a drive power to a motor 1M in the compressor 1. When the operation mode determination section 604 determines an operation mode, a fan drive control circuit 503 delivers a power supply voltage (the power supply 501) as an output upon receipt of the signal J. The output voltage of the fan drive circuit 503 is supplied as a drive power to a motor 11M in the outdoor fan 11.

The outdoor control section 50 comprises an inverter drive circuit 511, valve drive control circuit 512, valve drive control circuit 513, frost detecting section 514, preset valve circuit 515, difference detecting circuit 516 and preset value circuit 517.

The inverter drive circuit 51 has the following functions.

(1) A total of cooling power levels or a total of heating power levels requested from the respective indoor units are determined based on a signal K of the multi-control section 60.

(2) The output frequency of the inverter circuit 502 is controlled in accordance with a total value determined.

The valve drive control circuit 51 has the following functions.

(1) When a signal J of the multi-control section 60 represents the determination of a cooling operation mode, the two-way valve 10 is closed.

(2) When a signal J of the multi-control section 60 represents the determination of a heating operation mode, the two-way valve 10 is opened.

(3) When a defrost mode signal F is received from the frost detecting section 514, the aforementioned control operation as set out in section (2) above is stopped, closing the two-way valve 10.

The valve drive control circuit 513 performs the following functions.

(1) When a signal J of the multi-control section 60 represents the determination of the cooling operation mode, the PMV 4 is fully opened.

(2) When a signal J of the multi-control section 60 represents the determination of the heating operation mode, the PMV 4 is fully closed.

(3) When a defrost mode signal F is received from the frost detecting section 514, the aforementioned control operation as set out in section (2) above is stopped and the extent of opening of the PMV 4 (that is, a quantity of refrigerant into the outdoor heat exchanger 5) is so controlled that a detection result of the difference detecting circuit 516 becomes zero.

The frost detecting section 514 detects frost on the outdoor heat exchanger 5 by comparing a detection temperature T of the temperature sensor 12 with the preset value 0° C. of a preset value circuit 515, determines a "frosted" state when a state $T \geqq 0°$ C. continues for a predetermined time period, that is, when the detection temperature T is equal to, or less than, the preset value 0° C., sets a defrost mode and generates a defrost mode signal F. When the detection temperature T exceeds a preset value 10° C. of the preset value circuit 515 after the setting of the defrost mode, that is, when $T > 10°$ C., the defrost mode is released, stopping the generation of the defrost mode signal F.

The difference detecting circuit 516 detects a difference between the detection pressure of the pressure sensor 13 and a preset value 5 kg/cm$^2$G of the preset value circuit 517.

A pressure sensor 13, difference detecting circuit 516, valve drive control circuit 513 and PMV 4 constitute a second pressure control means.

The operation of the air-conditioner will be explained below.

Suppose that, for example, the indoor units C1, C2 and C3 request a cooling, a cooling and a heating operation mode, respectively, and that a total of cooling power levels requested is greater than a total heating power level requested.

Figure 5:
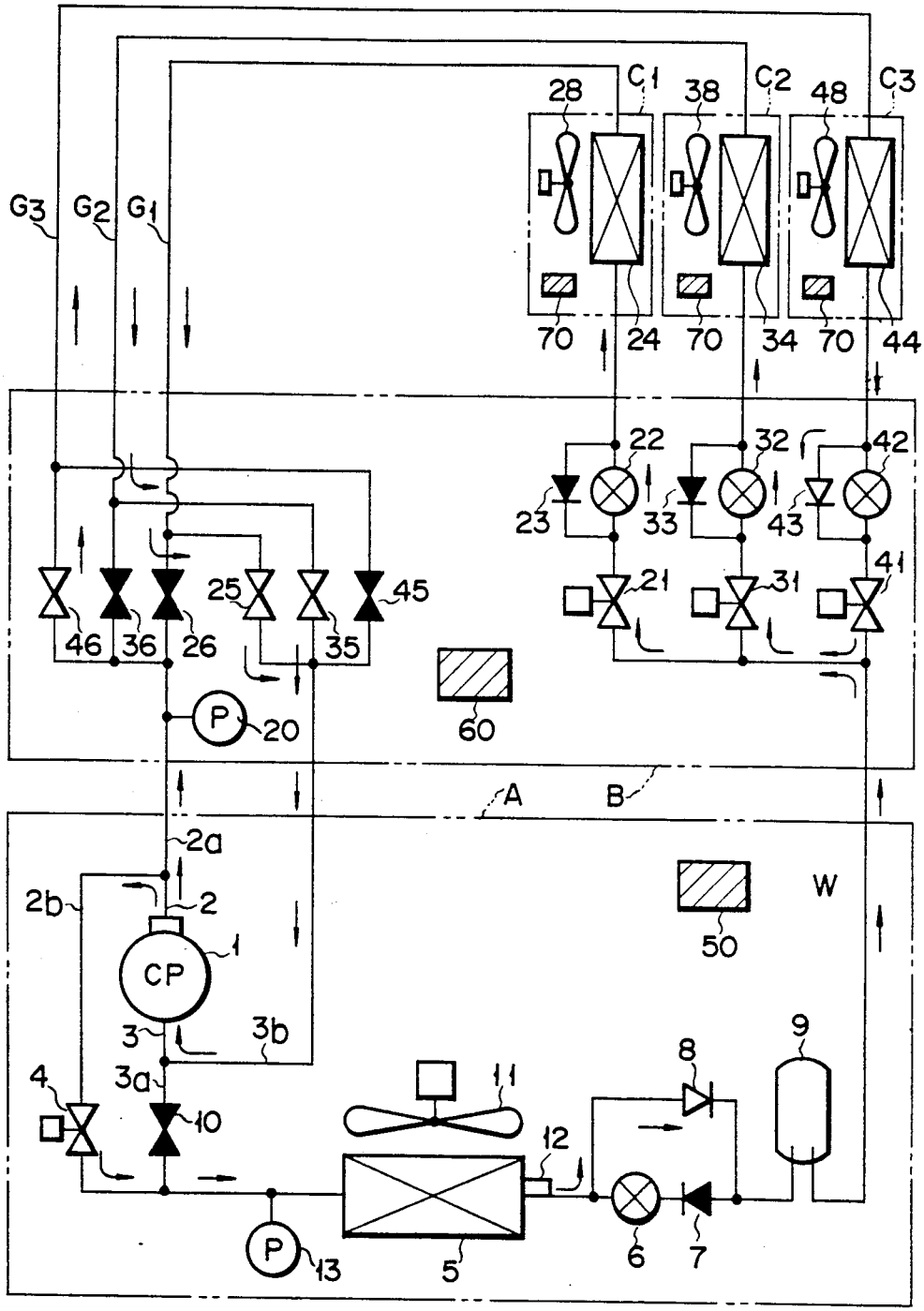
FIG. 5 is a view showing a flow of a refrigerant in a cooling operation mode of the aforementioned embodiment.

In this case, the cooling operation mode is determined and the PMV 4 in the outdoor unit A is fully opened as indicated by a white color in FIG. 5 and the two-way valve 10 is closed as indicated by a black color in FIG. 5.

That is, the outdoor heat exchanger 5 is connected to the delivery tube **2*b* of the compressor 1**.

In the branch unit B, the two-way valves 25, 35 and 46 are opened as indicated by a white color in FIG. 5 and two-way valves 26, 36 and 45 are closed by a black color in FIG. 5.

That is, the gas side tubes G1 and G2 of the indoor units C1 and C2 calling for their cooling operation modes are connected to the suction tube **3*b* of the compressor 1. The gas-side tube G3 of the indoor unit C3 calling for a heating operation mode is connected to the delivery tube 2*a* of the compressor 1**.

A refrigerant delivered from the compressor 1 enters the outdoor heat exchanger 5 via the PMV 4. The refrigerant is condensed in the outdoor heat exchanger 5. The refrigerant, after passing through the heat exchanger 5, flows through the check valve 8 and liquid tank 9 and enters the indoor units C1 and C2, respectively, through the PMVs 21 and 31 and expansion valves 22 and 32. In the indoor units C1 and C2, the refrigerant is evaporated. After passing through the indoor units C1 and C2, the refrigerant is sucked into the compressor 1 past the two-way valves 25 and 35.

One stream of the refrigerant delivered from the compressor 1 enters the indoor unit C3 past the two-way valve 46 and is condensed in the indoor unit C3. The refrigerant passing through the indoor unit C3 flows through the check valve 43 and PMV 41 into the indoor units C1 and C2 (PMVs 21 and 31) where the joining of the refrigerant streams occurs.

That is, the outdoor heat exchanger 5 serves as a condenser, indoor heat exchangers 24 and 34 as evaporators, and the indoor heat exchanger 44 as a condenser.

In this case, a portion of absorption heat at the indoor units C1 and C2 is utilized as heat liberation for the indoor units C3.

The output frequency of the inverter circuit 502 is set to a level corresponding to a total of the cooling power levels requested. Thus the compressor 1 performs a function adequately enough to cover the cooling capacity of the indoor units C1 and C2 of greater loads.

At this time, the extent of opening of the PMV's 21 and 31 is controlled in accordance with the cooling power levels requested from the indoor units C1 and C2, enabling the refrigerant to be properly distributed into the indoor units C1 and C2.

The extent of opening of the PMV 41 is controlled in accordance with the heating power level, allowing a proper amount of refrigerant to flow into the indoor unit C3.

Now let it be supposed that the indoor units C1, C2 and C3 request a heating, a heating and a cooling operation mode, respectively, and that a total of the heating power levels requested from the units C1 and C2 is greater than a total cooling power level requested from the indoor unit C3.

Figure 6:
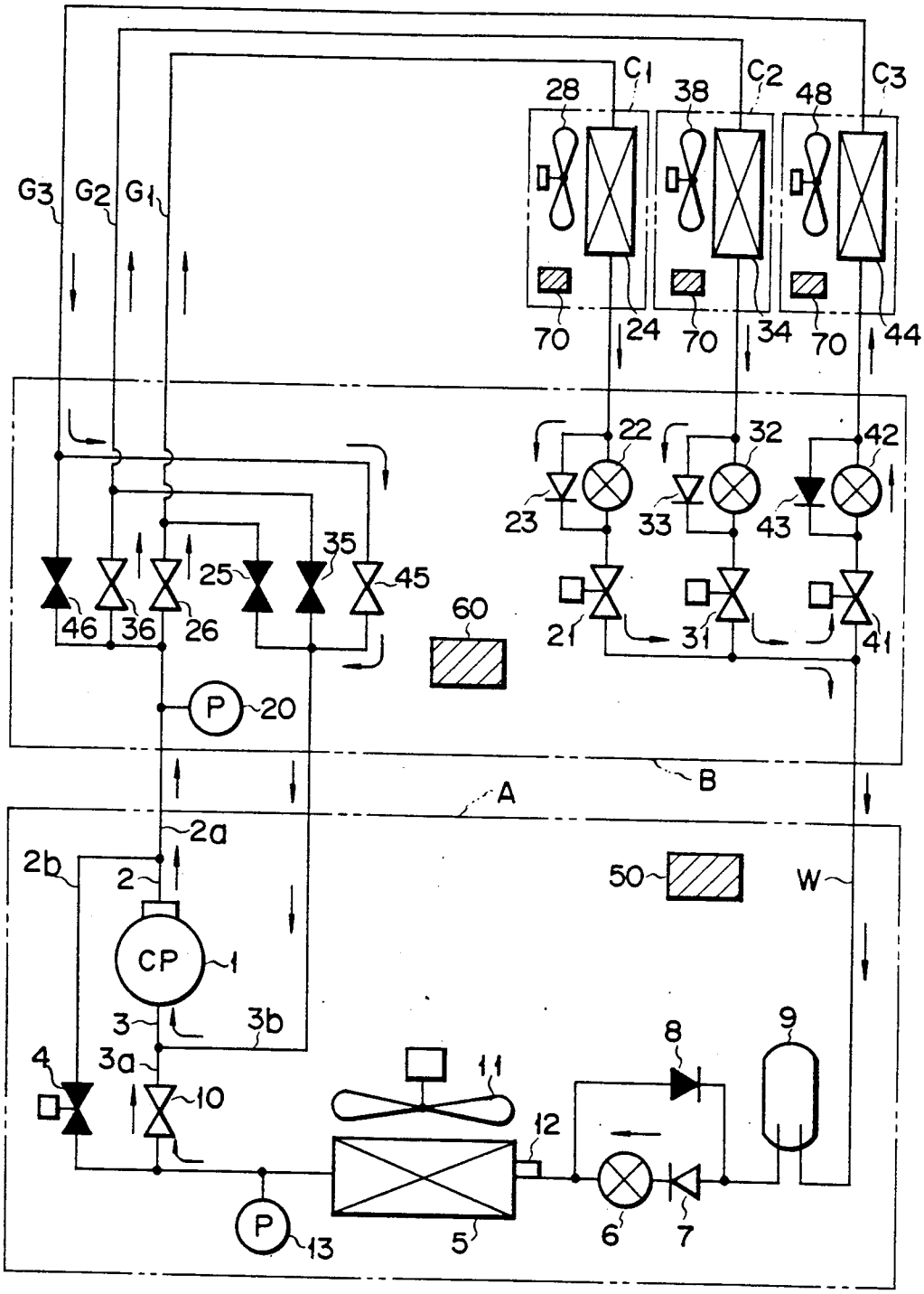
FIG. 6 is a view showing a flow of a refrigerant in a heating operation mode of the aforementioned embodiment.

In this case, the heating operation mode is determined and the PMV 4 of the outdoor unit A is fully closed as indicated by a black color in FIG. 6 and two-way valve 10 is opened as indicated by a white color in FIG. 6.

That is, the outdoor heat exchanger 5 is connected to the suction tube 3a of the compressor 1.

In the branch unit B, the two-way valves 45, 26 and 36 are opened as indicated by a white color in FIG. 6 and two-way valves 25, 35 and 46 are closed as indicated by a black color in FIG. 6.

The gas side tubes G1 and G2 of the indoor units C1 and C2 calling for the heating operation mode is connected to the delivery tube 2a of the compressor 1. The gas-side tube G3 of the indoor unit C3 calling for the cooling operation mode is connected to the suction tube 3b of the compressor 1.

Thus the refrigerant delivered from the compressor 1 enters the indoor units C1 and C2, respectively, via the two-way valves 26 and 36 and condensed at the indoor units C1 and C2. The refrigerants flowing through the indoor units C1 and C2 enters the liquid tank 9, respectively, through the check valves 23, 33 and PMVs 21 and 31 and the joined refrigerant flows from the liquid tank 9 via the expansion valve 6 into the outdoor heat exchanger 5 where it is evaporated. The evaporated form of refrigerant is sucked into the compressor 1 via the two-way valve 10.

Refrigerant streams flowing past the indoor units C1 and C2, check valves 23 and 33 and PMVs 21 and 31 are joined into the PMV 41 and a joined refrigerant there enters the indoor unit C3 past the expansion valve 42 where the refrigerant is evaporated. The evaporated form of refrigerant coming from the indoor unit C3 is sucked into the compressor 1 via the two-way valve 45.

That is, the indoor heat exchangers 24 and 34 serve as condensers, the outdoor heat exchangers 5 as an evaporator and the indoor heat exchanger 44 as an evaporator.

In this case, the heat of absorption in the outdoor heat exchanger 5 and indoor heat exchanger 44 is utilized as the liberation heat for the indoor units C1 and C2.

The output frequency of the inverter circuit 502 is set to a level corresponding to the total heating power level requested. Thus, the compressor 1 performs a function adequately enough to cover the heating capacity of the indoor units C1 and C2 of greater loads.

At this time, the extent of opening of the PMVs 21 and 31 is controlled in accordance with the heating power levels requested from the indoor units C1 and C2 and the refrigerant stream is properly distributed into the indoor units C1 and C2.

In the indoor unit C3, the extent of opening of the PMV 41 is controlled in accordance with the cooling power levels requested from the indoor unit C3 and a proper amount of refrigerant is flowed into the indoor unit C3.

During the operation of the air-conditioner, frost is deposited on the outdoor heat exchanger 5 serving as an evaporator. When the detection temperature of the temperature sensor 12 is continued lowered by frosting at 0° C. or below for a predetermined time period, then a defrost mode is set by the frost detecting section 514.

Figure 7:
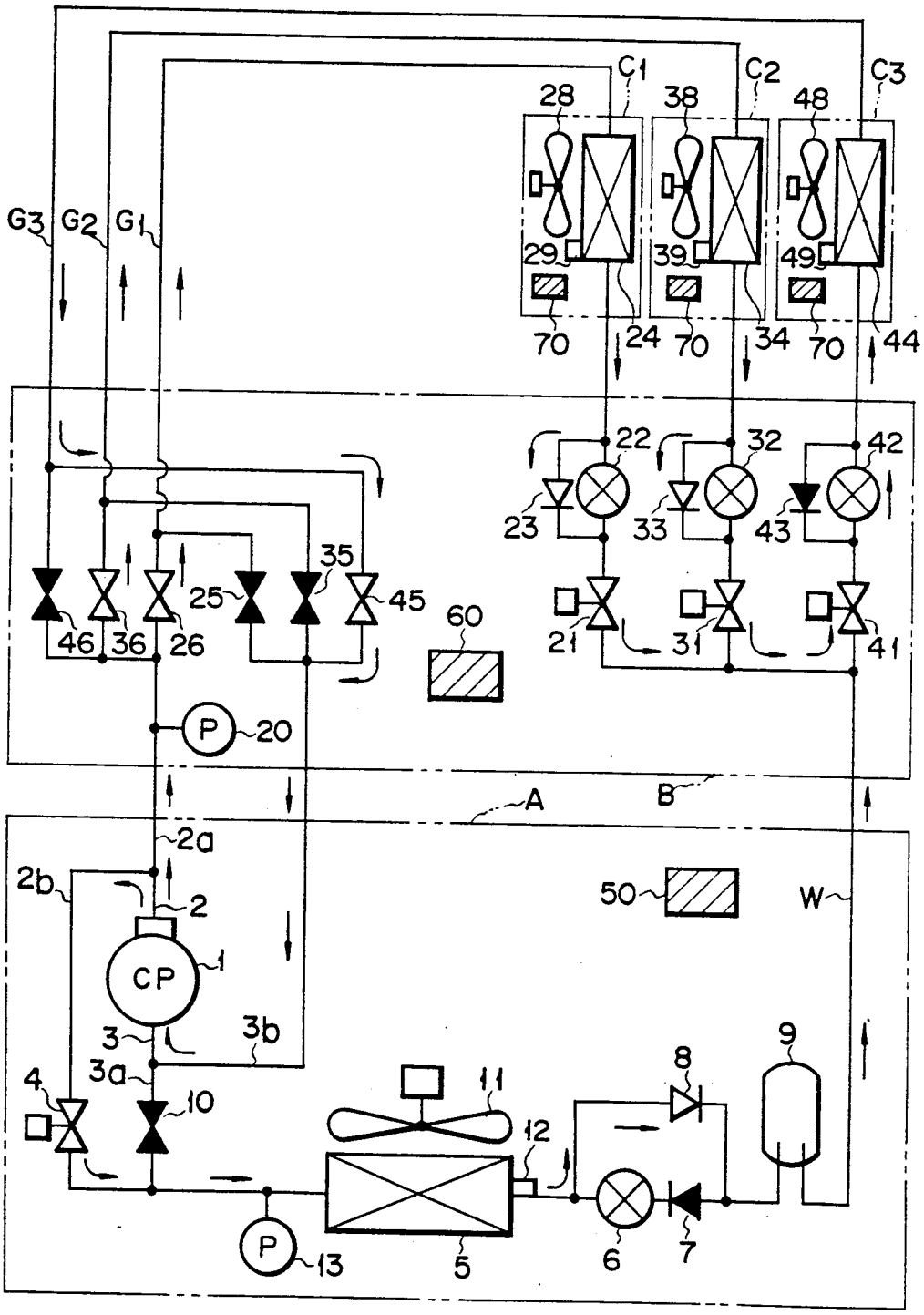
FIG. 7 is a view showing a flow of a refrigerant in a defrost mode of the aforementioned embodiment.

With the defrost mode set, the two-way valve 10 in the outdoor unit A is closed and PMV 4 is opened as shown in FIG. 7 in which case the respective two-way valves in the branch unit B remain unchanged.

Thus there is no variation in the directions of the refrigerant streams into the indoor units C1, C2 and C3 and a refrigerant stream delivered from the compressor 1 enters the compressor 1 via the PMV 4. Frost deposited on the outdoor heat exchanger 5 is thawed by the heat of the refrigerant A refrigerant stream coming from the outdoor heat exchanger 5 flows past the check valve 8 and liquid tank 9 and then past the PMV 41 and the joining of the refrigerant stream coming past the PMVs 21 and 31 and that entering the indoor unit C3 occurs.

At the time of defrosting, a pressure prevalent in the refrigerant streams into the heat-side indoor units C1 and C2 is detected by the pressure sensor 20 and the extent of opening of the PMVs 21 and 31 is so controlled that the detection pressure is preset to 15 $kg/cm^2G$.

That is, the detection pressure, if being lower than the preset value 15 $kg/cm^2G$, is so controlled as to work in a direction in which the extent of opening of the PMVs 21 and 31 is closed. If the detection pressure is greater than the preset level 15 $kg/cm^2G$, it is so controlled as to work in a direction in which the extent of opening of the PMVs 21 and 31 is opened.

Such a controlling operation ensures a condensing temperature enough adequate to heat the indoor units C1 and C2.

At the same time, a pressure prevalent in the refrigerant stream into the outdoor heat exchanger is detected by the pressure sensor 13 and the extent of opening of the PMV 4 is so controlled that the detection pressure is preset to a level 5 $kg/cm^2G$.

That is, if the detection pressure is lower than the preset level 5 $kg/cm^2G$, the extent of opening of the PMV 4 is controlled in a direction in which the PMV 4 is opened. If, on the other hand, the detection pressure is higher than the preset level 5 $kg/cm^2G$, the extent of opening is controlled in a direction in which the PMV 4 is closed.

Such a control operation prevents the use of too much a heat upon defrosting and prevents a drop in the heating power level under the control of the aforementioned PMV's 21 and 31.

Figure 8:
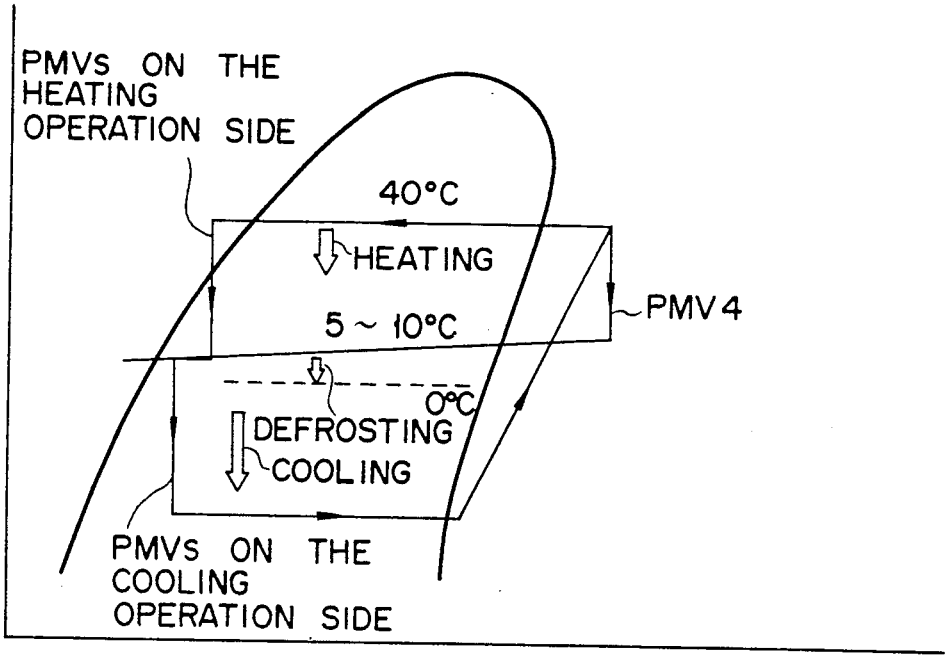
FIG. 8 is a Mollier diagram showing the states of the aforementioned embodiment.

The state of the refrigeration cycle is indicated by the Mollier diagram in FIG. 8

Since, in this way, defrosting of the outdoor heat exchanger 5 is ensured while the heating operation of the heating-side indoor units C1 and C2 continues and since, during defrosting, the refrigerant pressure is controlled to a given optimal level to ensure an adequate heating power level, a comfortable heating operation can be carried out at all times.

When, upon continued defrosting, the detection temperature T of the temperature sensor 12 exceeds 10° C. ($T > 10°$ C.), the defrost mode is released and the two-way valve 10 is opened, while the PMV 4 is fully closed. That is, it is possible to regain a normal heating operation mode.

A second embodiment of the present invention will be explained below with reference to FIGS. 9 and 10. The same reference numerals are employed to designate parts or elements corresponding to those shown in conjunction with the first embodiment and further explanation, therefore, omitted for brevity's sake.

Figure 9:
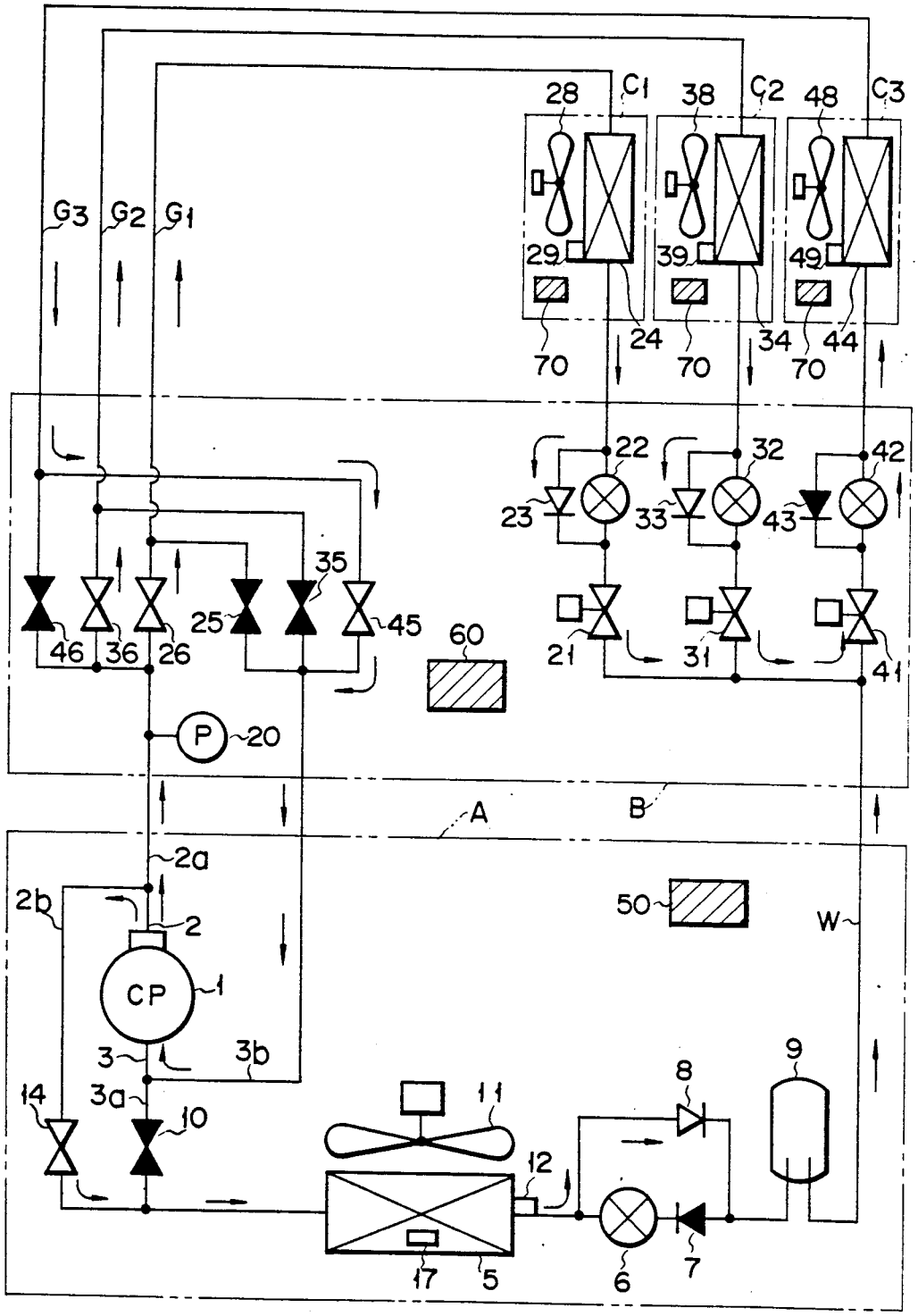
FIG. 9 is a view showing a refrigerating apparatus according to a second embodiment of the present invention.

As shown in FIG. 9, a pressure sensor 13 is eliminated from an outdoor unit A and an electromagnetic two-way valve 14 is employed in place of the PMV 4.

Figure 10:
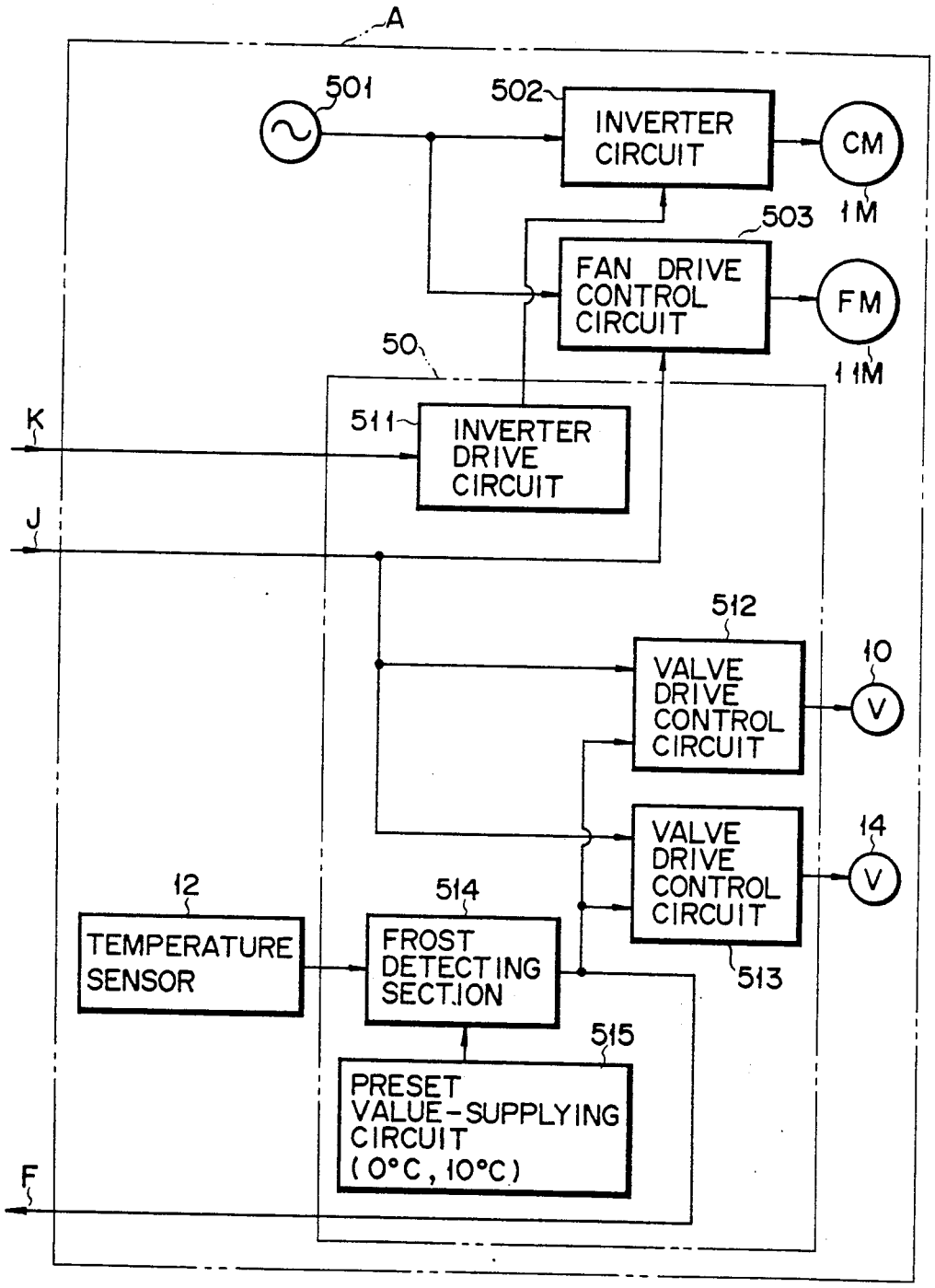
FIG. 10 is a block diagram showing an outdoor control section and its associated circuits of the aforementioned embodiment.

As shown in the embodiment of FIG. 10, the difference detecting circuit 516 and preset value circuit 517 have been eliminated from the previous embodiment. The two-way valve 14 is connected to a valve drive control circuit 513 in an outdoor control section 50.

The operation of the air-conditioner will be explained below.

During defrosting, a pressure prevalent in refrigerant streams into heating-side indoor units C1 and C2 is detected by a pressure sensor 20 and the extent of opening of PMVs 21 and 31 are so controlled that the detection pressure is preset to a level 15 kg/cm$^2$G.

A pressure prevalent in a refrigerant stream into the outdoor heat exchanger 5 is not controlled.

In this way, a pressure prevailing in the refrigerant streams into the indoor units C1 and C2 ensures a comfortable heating power level if only it is controlled to a given level.

Although, in the aforementioned respective embodiment, the three indoor units have been explained as being present, the present invention cannot be restricted to them and four or more indoor units may be employed according to the present invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A multi-system air conditioner comprising:

an outdoor unit including a compressor for sucking a refrigerant, compressing it and delivering it and an outdoor heat exchanger for allowing an exchange of a heat of an incoming refrigerant and a heat of outdoor air;

a plurality of indoor units each including an indoor heat exchanger for allowing an exchange of a heat of an incoming refrigerant and a heat of indoor air and requesting either one of a cooling operation mode and cooling power level and a heating operation mode and heating power level;

means for determining a cooling operation mode when a total of a cooling power level or levels requested from one or more indoor units is greater than a total of a heating power level or levels requested from one or more remaining indoor units;

means for enabling the refrigerant which is delivered from the compressor to pass through the outdoor heat exchanger, when the cooling operation mode is determined, and to be returned back to the compressor through one or more indoor units calling for the cooling operation mode;

means for enabling a stream of the refrigerant which is delivered from the compressor to pass through one or more indoor units calling for the heating operation mode, when the cooling operation mode is determined, and to enter the stream of the refrigerant flowing into one or more indoor units calling for the cooling operation mode;

means for determining the heating operation mode when a total of a heating power level or levels requested from one or more indoor units is greater than a total of a cooling power level or levels requested from one or more remaining indoor units;

means for enabling the refrigerant which is delivered from the compressor to pass through one or more indoor units calling for the heating operation mode, when the heating operation mode is determined, and to be returned back to the compressor via the outdoor heat exchanger;

means for enabling one stream of the refrigerant which passes through one or more indoor units calling for the heating operation mode to flow through one or more indoor units calling for the cooling operation mode, when the heating mode is determined, and to be returned back to the compressor;

means for setting a defrost mode, as required, when the heating operation mode is determined;

means for enabling the refrigerant which is delivered from the compressor to pass through one or more indoor units calling for the heating operation mode, when the defrost mode is set, and to be returned back to the compressor through one or more indoor units calling for the cooling operation mode;

means for enabling one stream of the refrigerant which is delivered from the compressor to pass through the outdoor heat exchanger, when the defrost mode is set, and to enter the stream of the refrigerant flowing into one or more indoor units calling for the cooling operation mode;

first pressure control means for maintaining, at a preset level, a pressure prevalent in one or more indoor units calling for the heating operation mode, when the defrost mode is set; and second pressure control means for maintaining, at a preset level, a pressure prevalent in the refrigerant flowing into the outdoor heat exchanger, when the defrost mode is set.

2. The air conditioner according to claim 1, wherein said compressor has a suction inlet and delivery outlet for a refrigerant.

3. The air conditioner according to claim 1, wherein said setting means comprises a temperature sensor for detecting a temperature of said outdoor heat exchanger and a frost detecting section for detecting frost in said outdoor heat exchanger by comparing a detection temperature of the temperature sensor with said preset value and, when the frost detecting section detects the frost in said outdoor heat exchanger, setting a defrost mode.

4. The air conditioner according to claim 1, wherein said first pressure control means comprises a pressure sensor for detecting a pressure prevalent in a refrigerant flowing into one or more indoor units calling for a heating operation mode, a difference detecting circuit for detecting a difference between a detection pressure of the pressure sensor and a preset level, and a pulse motor valve for controlling an amount of refrigerant flowing through one or more indoor units calling for the heating operation mode, such that a result of detection by the difference detecting circuit becomes zero.

5. The air conditioner according to claim 1, wherein said second pressure control means comprises a pressure sensor for detecting a pressure prevalent in a refrigerant flowing into the outdoor heat exchanger, a difference detecting circuit for detecting a difference between a detection pressure of the pressure sensor and a preset valve, and a pulse motor valve for controlling an amount of refrigerant flowing into the outdoor heat exchanger, such that a result of detection by the difference detecting circuit becomes zero.

6. A multi-system air conditioner comprising:

an outdoor unit including a compressor for sucking a refrigerant, compressing it and delivering it and an outdoor heat exchanger for allowing an exchange of a heat of an incoming refrigerant and a heat of outdoor air;

a plurality of indoor units each including an indoor heat exchanger for allowing an exchange of a heat of an incoming refrigerant and a heat of indoor air and requesting either one of a cooling operation mode and cooling power level and a heating operation mode and heating power level;

means for determining a cooling operation mode when a total of a cooling power level or levels requested from one or more indoor units is greater than a total of a heating power level or levels requested from one or more remaining indoor units;

means for enabling a refrigerant which is delivered from the compressor to pass through the outdoor heat exchanger, when a cooling operation mode is determined, and to be returned back to the compressor through one or more indoor units calling for the cooling operation mode;

means for enabling one stream of the refrigerant which is delivered from the compressor to pass through one or more indoor units calling for the heating operation mode, when the cooling operation mode is determined, and to enter the stream of the refrigerant flowing into one or more indoor units calling for the cooling operation mode;

means for determining the heating operation mode when a total of a heating power level or levels requested from one or more indoor units is greater than a total of a cooling power level or levels requested from one or more remaining indoor units;

means for enabling the refrigerant which is delivered from the compressor to pass through one or more indoor units calling for the heating operation mode, when the heating operation mode is determined, and to be returned back to the compressor; via the outdoor heat exchanger;

means for enabling one stream of the refrigerant which passes through one or more indoor units calling for the heating operation mode to pass through one or more indoor units calling for the cooling operation mode, when the heating operation mode is determined, and to be returned back to the compressor;

means for setting a defrost mode, as required, when the heating operation mode is determined;

means for enabling the refrigerant which is delivering from the compressor to pass through one or more indoor units calling for the heating operation mode, when the defrost mode is set, and to be returned back to the compressor through one or more indoor units calling for the cooling operation mode;

means for enabling one stream of the refrigerant which is delivered from the compressor to pass through the outdoor heat exchanger, when the defrost mode is set, and to enter the stream of the refrigerant flowing into one or more indoor units calling for the cooling operation mode; and means for maintaining, at a preset valve, a pressure prevalent in the refrigerant flowing into one or more indoor units calling for the heating operation mode, when the defrost mode is set.

7. The air-conditioner according to claim 6, wherein said compressor has a suction inlet and delivery outlet for a refrigerant.

8. The air conditioner according to claim 6, wherein said setting means comprises a temperature sensor for detecting a temperature of said outdoor heat exchanger and a frost detecting section for detecting frost in said outdoor heat exchanger by comparing a detection temperature of the temperature sensor and a preset level and setting a defrost mode when the frost detecting section detects the frost in the outdoor heat exchanger.

9. The air conditioner according to claim 6, wherein said maintaining means comprises a pressure sensor for detecting a pressure prevalent in a refrigerant flowing into one or more indoor units calling for a heating operation mode, a difference detecting circuit for detecting a difference between a detection pressure of the pressure sensor and a preset level, and a pulse motor valve for controlling an amount of refrigerant flowing through one or more indoor units calling for the heating operation mode, such that a result of detection by the difference detecting circuit becomes zero.

* * * * *